US005588224A

United States Patent [19]

Gianforte et al.

[11] Patent Number: 5,588,224

[45] Date of Patent: Dec. 31, 1996

[54] CHILL ROLL ASSEMBLY

[75] Inventors: John S. Gianforte, Southlake; Anthony C. Cox, Hurst, both of Tex.

[73] Assignee: EGS Americas, Inc.

[21] Appl. No.: 488,381

[22] Filed: Jun. 7, 1995

[51] Int. Cl.[6] ..... F26B 3/00

[52] U.S. Cl. ..... 34/447; 34/121; 34/482

[58] Field of Search ..... 34/447, 121, 482, 34/547, 560, 561

[56] References Cited

U.S. PATENT DOCUMENTS

| | | | |
|---|---|---|---|
| 1,144,896 | 6/1915 | Fosbraey . | |
| 2,760,410 | 8/1956 | Gillis | 92/38 |
| 2,812,594 | 11/1957 | Lamason | 34/121 |
| 3,067,586 | 12/1962 | Offen | 62/63 |
| 3,191,312 | 6/1965 | Allander | 34/13 |
| 3,848,341 | 11/1974 | Linder | 34/447 |
| 4,495,712 | 1/1985 | Justus | 34/121 |
| 4,497,121 | 2/1985 | Choinski | 34/447 |
| 4,521,931 | 6/1985 | Katsuki et al. | 34/561 |
| 4,646,540 | 3/1987 | Blackwood et al. | 62/373 |
| 4,718,982 | 1/1988 | Swenson et al. | 162/206 |
| 4,744,771 | 10/1988 | Littleton | 34/62 |
| 4,908,958 | 3/1990 | Sollinger et al. | 34/121 |
| 4,920,881 | 5/1990 | Tafel | 101/488 |
| 5,036,600 | 8/1991 | Webster et al. | 34/62 |
| 5,121,560 | 6/1992 | Daane et al. | 34/13 |
| 5,311,672 | 5/1994 | Kotitschke et al. | 34/117 |
| 5,377,428 | 1/1995 | Clark | 34/447 |

FOREIGN PATENT DOCUMENTS

| | | | |
|---|---|---|---|
| 2246586 | 4/1973 | Germany | 34/447 |
| 2124670 | 2/1984 | United Kingdom | 34/447 |

*Primary Examiner*—John T. Kwon

*Attorney, Agent, or Firm*—Jenkens & Gilchrist

[57] ABSTRACT

A chill roll assembly is disclosed having plural harmonic drives for rotationally driving corresponding plural sets of chill rolls. The harmonic drives are independently controllable to support either synchronous or asynchronous chill roll assemble operation. Synchronous mode facilitates the processing through the chill roll assembly of a single web. Asynchronous mode, on the other hand, facilitates the processing of multiple webs through the chill roll assembly.

13 Claims, 4 Drawing Sheets

CHILL ROLL ASSEMBLY

BACKGROUND OF THE INVENTION

1. Technical Field of the Invention

The present invention relates to a chill roll assembly for drying flexible sheet material and, more particularly, to a chill roll assembly selectively operable to dry one or more continuous sheets.

2. Description of Related Art

Growing demands by consumers for products, such as cellophane or paper, fabricated in sheet form and then cut down to a selected size, has resulted in pressure on manufacturers to increase production for a period of time. However, increasing production is difficult to achieve because such additional production often requires the use of additional equipment. To solve this problem, chill roll machines have been used which allow multiple sheets of material, or webs, to simultaneously pass through the machine for cooling. In one such machine, a first web is passed through an upper set of cooling rolls while a second web is passed through a lower set of cooling rolls. Other than allowing for the processing of multiple webs, or sheets, without requiring an additional machine at additional expense, multi-web machines are advantageously used where the amount of space available for the equipment is limited. On the other hand, a drawback with such machines is that only half of the machine is used if only one web is processed thereby reducing efficiency.

One device used to process webs is a chill roll assembly. A typical chill roll assembly uses one harmonic drive to actuate a set of four chill rolls. The harmonic drive is a device which, when mechanically coupled to a press for driving a plurality of chill rolls, allows the spin speed of the outer surface of the chill rolls to be adjusted a small percentage in relation to the press speed thereby allowing a tension adjustment in the web as it passes through the chill roll apparatus. With the advent of programmable logic controllers, the amount of tension in a given web is programmable and adjustable. Current chill roll assemblies, however, are only adapted to pass one web. Thus, multiple assemblies are required for handling multiple webs.

SUMMARY OF THE INVENTION

The chill roll assembly of the present invention comprises a plurality of sets of chill rolls. The operation of the plural sets of chill rolls is controlled by a multi-mode control system implementing a first synchronous mode of operation and a second asynchronous mode of operation. In the first mode, the plural sets of chill rolls are synchronously driven to facilitate the processing of a single web through the chill roll assembly. Conversely, in the second mode, the plural sets of chill rolls are asynchronously driven to facilitate the processing of multiple webs through the chill roll assembly.

More particularly, the chill roll assembly utilizes a plurality of harmonic drive systems, one harmonic drive system per included set of chill rolls. The multi-mode controller comprises a control system associated with each of the harmonic drives for controlling actuation of the drives and rotation of the set of chill rolls connected thereto. Responsive to an indication of operation in the first mode, the control systems synchronize operation of the harmonic drives and thereby control tension of the single web passing through the sets of chill rolls. Responsive to an indication of operation in the second mode, the control systems operate the harmonic drives in asynchronous mode and thereby control tension of the multiple webs being manipulated through the chill role assembly.

In accordance with a method of the present invention for controlling multi-mode operation of a chill roll assembly having at least two sets of chill rolls wherein there is a controller for each set of chill rolls, an output voltage is calculated for each controller based upon a desired tension setting and press speed and a selected mode of operation. If asynchronous mode is selected, the calculated output voltages cause the drive means for rolls, and ultimately the sets of chill rolls, to be actuated at separate and different rates to process multiple webs. If synchronous mode of operation is desired, the output voltage is recalculated to set the output voltage for every other controller substantially equal to the voltage being output by the first controller. The output voltages cause the drive means for each set of chill rolls, and ultimately the sets of chill rolls, to be actuated to rotate at substantially the same rate to process a single web.

BRIEF DESCRIPTION OF THE DRAWINGS

These and other features of the present invention will become apparent to those skilled in the art upon reading the following description of a preferred embodiment in view of the accompanying drawings wherein.

DETAILED DESCRIPTION OF EMBODIMENTS

Figure 1:
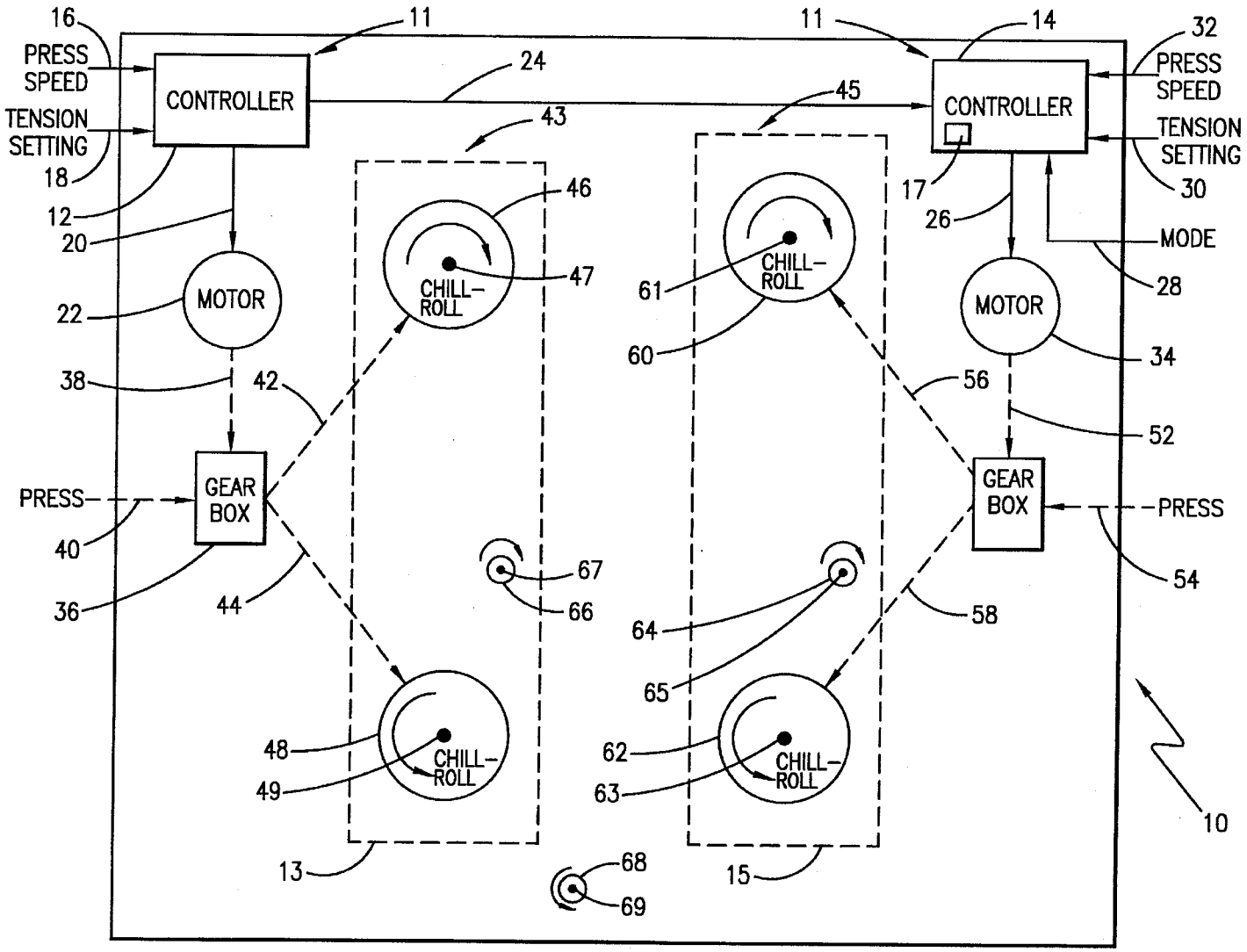
FIG. 1 is a schematic diagram of the chill roll assembly of the present invention.

Referring now to FIG. 1, there is shown a chill roll assembly 10 having two sets of chill rolls 43 and 45 and two corresponding drive means 13 and 15. Drive means 13 activates chill rolls 46 and 48 of chill roll set 43 through drive shafts 42 and 44. Drive means 15 activates chill rolls 60 and 62 of chill roll set 45 through drive shafts 56 and 58. Accordingly, each set of chill rolls 43 or 45 has its own drive means 13 or 15, respectively, to support independent chill roll set operation and thus allow the simultaneous processing of two webs.

A signal line 24 connects an output of drive means 13 to a means for synchronizing 17 of drive means 15. The means for synchronizing 17 functions to synchronize the rotation of chill rolls 60 and 62 of chill roll set 45 with chill rolls 46 and 48 of chill roll set 43. The synchronizing of the chill roll sets 45 and 43 therefore allows the manipulation of one web through both sets of chill rolls. Alternatively, if an operator desires to manipulate two webs through the chill roll assembly 10, then asynchronous mode of operation allows each drive means 13 or 15 to independently control its chill roll set 43 or 45, respectively.

Continuing to refer to FIG. 1, there is shown a control 11 comprising a controller 12 of drive means 13 and a controller 14 of drive means 15. The controller 12 of drive means 13 receives a signal indicative of press speed on line 16 from an external source and a signal indicative of a desired tension setting over line 18 wherein the tension setting may either originate from an external source or from a tension setting means (not shown) on a panel associated with said controller 12. A typical tension setting means, by way of example, is a control on a panel or a computer controlled selection based upon operator input.

The primary output of first controller 12 is a voltage, V-Out$_1$, in the range of 0 to 30 volts, which is output over line 20 for actuating the first harmonic drive motor 22. First controller 12 also produces an output signal indicative of the numerical value of the V-Out$_1$ which is output over line 24 to the second controller 14.

The second drive means 15, similar to drive means 13, comprises a controller 14 which receives a signal indicative of press speed on line 32 from an external source and a signal indicative of tension setting over line 30 wherein the tension setting may either originate from an external source or from a tension setting means (not shown) on a panel associated with said controller 14. A typical tension setting means, by way of example, is a control on a panel or a computer controlled selection based upon operator input.

The primary output of first controller 14 is a voltage, V-Out$_2$, in the range of 0 to 30 volts, which is output over line 26 for actuating the first harmonic drive motor 34. The V-Out$_1$ signal reflecting the value of the voltage V-Out$_1$ which was output over line 24 is received as an input to controller 14 over line 24. Additionally, the second controller 14 has an input signal over line 28 indicating the selected mode of operation, namely synchronous or asynchronous.

Therefore, if asynchronous mode of operation is selected, as indicated by the signal on line 28, then the second controller 14 will operate independently of the first controller 12 and will produce an output voltage V-Out$_2$ according to the tension setting as received over line 30 and the signal reflective of press speed as received over line 32. However, if the signal received on line 28 indicates that synchronous mode has been selected, then the second controller 14 will set its output voltage V-Out$_2$ on line 26 to equal the value of V-Out$_1$ as reflected on line 24. Therefore, V-Out$_2$ is set equal to V-Out$_1$ from the first controller. Accordingly, the equivalent voltages to the motors 22 and 34 result in the motors producing a substantially equivalent rotational output on lines 38 and 52 which, in turn, act as the only variable inputs to the harmonic gear boxes 36 and 50. Therefore, since the only other rotational input to the gear boxes 36 and 50 is the press drive which remains constant, the output to the gear boxes 36 and 50 is substantially equivalent as seen on drive shafts 42 and 44 for harmonic gear box 36 and drive shafts 56 and 58 for harmonic gear box 50. Resultingly, the rotational speeds for each of the chill roll sets 43 and 45 are substantially equal.

It is worth noting that, in this specific embodiment, the second controller merely receives a signal indicative of the output potential V-Out$_1$ of the first controller 12 wherein a means for synchronizing 17 within the second controller 14 causes the second controller 4 to produce an output voltage V-Out$_2$ potential equal to the output voltage V-Out$_1$. This same result may be accomplished by other equivalent embodiments. For example, the output of the second controller may be physically switched to place it in a parallel connection to output V-Out$_1$ of the first controller 12. In such an embodiment, the first controller 12 would have to be capable of driving two harmonic motors 22 and 34 in terms of output power or, alternatively, a circuit (not shown) would have to be added to provide additional power for the second harmonic motor 34. In another embodiment, a signal is transmitted to the second controller 14 from the first controller 12 indicating the tension setting chosen for the first controller 12 wherein said second controller 14 provides an output potential V-Out$_2$ to correspond to the first controller's tension setting whenever the selected mode is synchronous. The resulting potential V-Out$_2$, then, is substantially equal to V-Out$_1$.

Each of the harmonic motors 22 and 34 actuates a drive shaft whose rotational speed is a direct function of the input voltage potential V-Out$_2$ received on lines 20 and 26, respectively. By way of example, if the received voltage signal is equal to 30 volts, the harmonic drive motor drive shaft revolves at 5,000 revolutions per minute (rpm). Therefore, if each of the harmonic motors 22 and 24 receives an equal voltage from its controller 12 or 14, each motor 22 or 24 will produce a substantially similar rotational output on harmonic drive motor shafts 38 and 52.

These harmonic drive motor drive shafts 38 and 52 are, in turn, are connected to the harmonic drive gear boxes 36 and 50. Specifically, harmonic drive motor 22 is mechanically connected to harmonic drive gear box 36 via drive shaft 38 and harmonic drive motor 34 is mechanically connected to harmonic drive gear box 50 via drive shaft 52. Harmonic drive gear boxes 36 and 50 also receive a rotational input from press over drives 40 and 54. The corresponding output of the harmonic drive gear boxes 36 and 50 is the mechanical sum of the rotational inputs received via drives 38 and 40 and drives 52 and 54, respectively. Thus, because the rotational input from the press drive over drives 40 and 54 is equal and the rotational inputs from motors 22 and 34 over shafts 38 and 52 are substantially equal, the gear boxes 26 and 50 produce substantially similar outputs on drive 42 and 44 for gear box 36 and drives 56 and 58 for gear box 50.

By way of example, in one embodiment of the invention herein, plus or minus 200 revolutions of drive shaft 38 result in a plus or minus one output revolution from the harmonic drive gear box 36 (i.e., one revolution in a direction opposite that of drive shaft 38). On the other hand, 200 revolutions from said press drive 40 results in 201 revolutions at the output of the harmonic drive gear box 36. Thus, because the harmonic gear boxes 36 and 50 each receive rotational inputs from the press drive and their respective harmonic motors 22 or 34, 200 revolutions of drive 40 and 200 revolutions of drive 38 will result in an output on drive shafts 42 and 44 equal to 200 rpm. Accordingly, chill rolls 46 and 48 of chill roll pair 47 will spin at 200 rpm. As may be seen, the output revolutions for a 200 rpm input at drive 40 will be in the range from 202 rpm's to 200 rpm's as the harmonic drive produces an input to the gearbox on drive 38 ranging from −200 to 200 rpm's, respectively.

Similarly, harmonic drive gear box 50 will, when receiving an input of 200 rpm from drive shaft 52 and 200 rpm from drive shaft 54, produce output of 200 rpm on drive shafts 56 and 58. Resultingly, chill rolls 60 and 62 will spin at 200 rpm. From these numbers it is clear that the effect of the harmonic drive is to vary the gear box output over the press speed by approximately plus or minus 0.5% depending upon the polarity of voltage potential V-Out$_1$ and thus upon the rotational direction of drive 38. The specific results, however, are a matter of choice according to the design goals of the practitioner.

Figure 2:
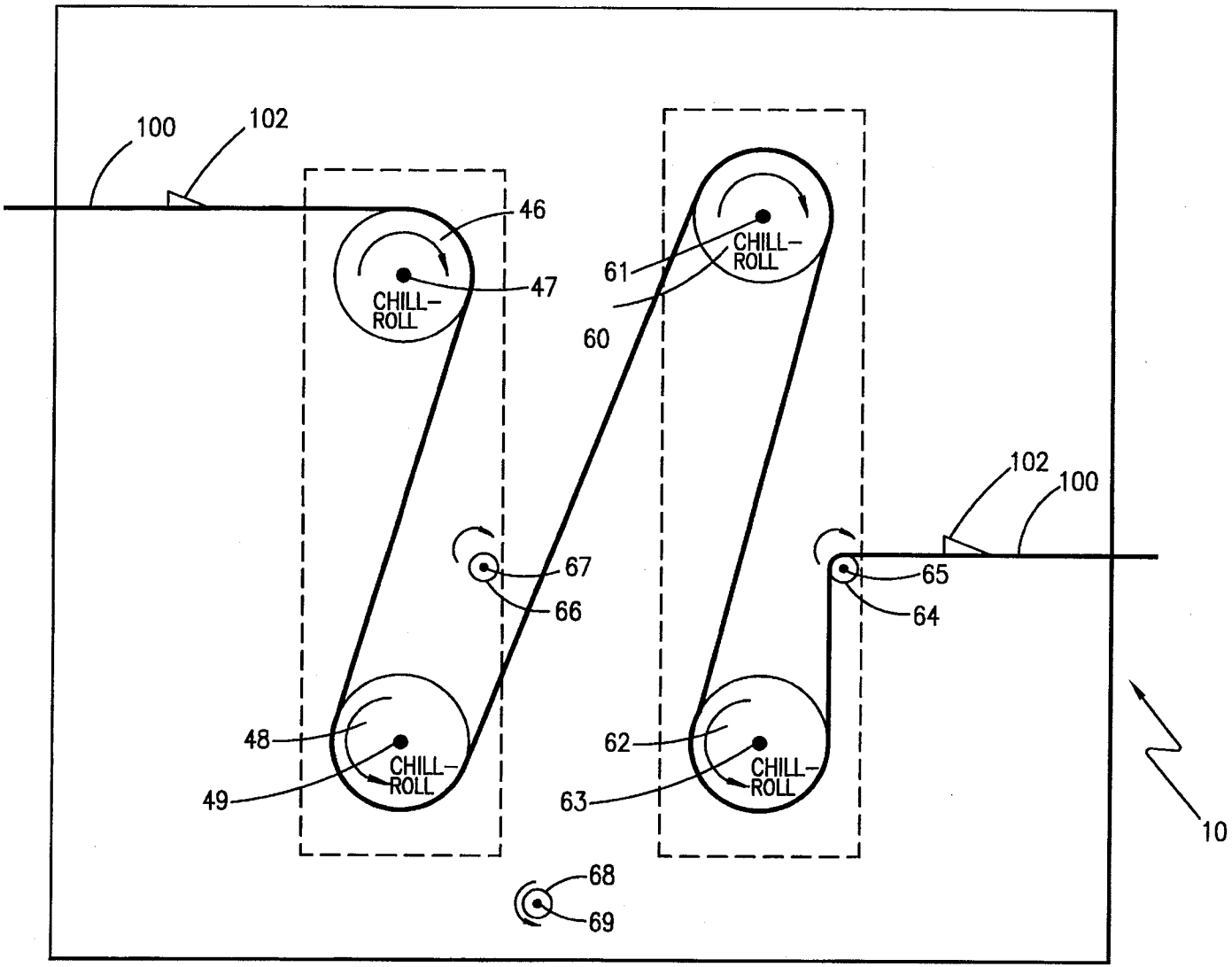
FIG. 2 illustrates the use of the chill roll assembly of FIG. 1 to process a single web.

Referring now to FIG. 2, there is shown an application of the present invention adapted for processing one web 100 in response to a signal on line 28 reflecting synchronous mode operation. As may be seen, web 100 enters the chill roll assembly 10 to proceed around the various chill rolls in direction indicated by arrow 102. Specifically, the web 100 first proceeds around chill roll 46 which rotates in a clockwise direction. Thereafter, web 100 proceeds to chill roll 48 which rotates around axis 49 in a counterclockwise direction. Thereafter, the web 100 proceeds around chill roll 60 and rotates around a axis 61, again in a clockwise direction. Thereafter, web 100 rotates around chill roll 62 which rotates around axis 63 in counterclockwise direction. Finally, the web rotates around idler 64 which rotates clockwise about axis 65 and exits the chill roll assembly 10.

As may be seen from the foregoing illustration, web 100 can only properly rotate around the four chill rolls if the two harmonic drive systems are synchronized. Specifically, controller 12, harmonic drive motor 22, and harmonic drive gear box 36 must be synchronized with controller 14, harmonic drive motor 34, and harmonic drive gear box 50. If the rotational speeds of the chill rolls 60 and 62 of the second pair 45, are different from the rotational speeds of chill rolls 46 and 48 of the first pair 43, then the web 100 would either be subjected to stresses which could result in tearing or in excessive gathering which may result in a jam as a result of the pairs 43 and 45 of chill rolls not being rotationally synchronized. Thus, the output voltage V-Out$_2$ must substantially equal to V-Out$_1$ so that the chill roll pairs 43 and 45 will operate at substantially the same speed thereby allowing one web to pass through both pairs 43 and 45 of the chill rolls.

Figure 3:
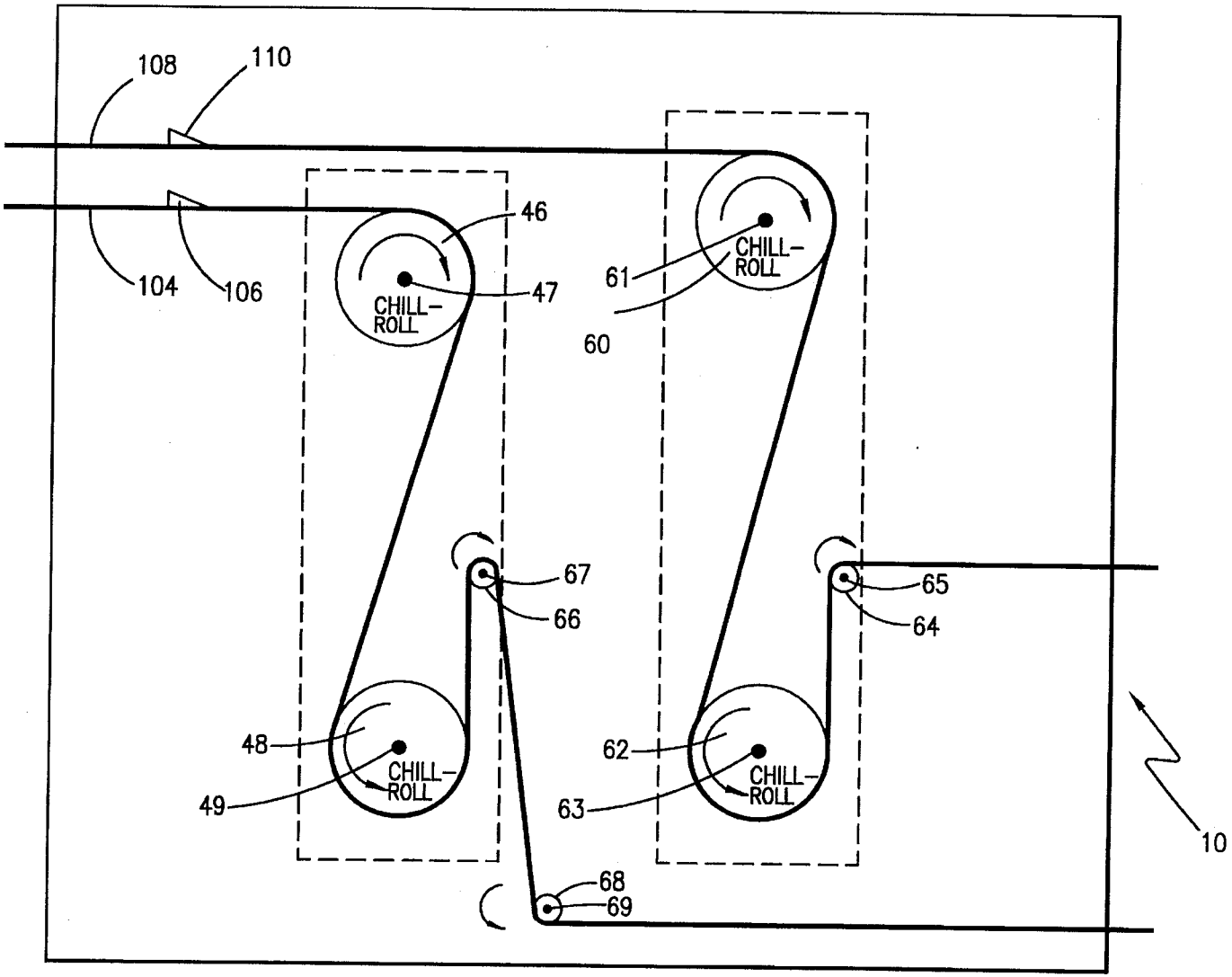
FIG. 3 illustrates the use of the chill roll assembly of FIG. 1 to process multiple webs.

Referring now to FIG. 3, there is shown an embodiment of the present invention adopted for processing multiple webs 104 and 108. The first web 104 enters the chill roll assembly and moves in a direction indicated by arrow 106. The second web 108 enters the chill roll assembly in a direction indicated by arrow 110. First web 104 proceeds around chill roll 46 which rotates about axis 47 in a clockwise direction. Thereafter, first web 104 proceeds around chill roll 48 which rotates around axis 49 in a counterclockwise direction. The first web 104 then bypasses the second pair 45 of chill rolls 60 and 62 and proceeds around idler 66 which rotates in a clockwise direction about axis 67. Thereafter, web 104 proceeds around idler 68 which rotates about axis 69 in a counterclockwise direction.

Second web 108 enters the chill roll assembly and proceeds about chill roll 60 in a clockwise direction about axis 61. Thereafter, second web 108 proceeds about chill roll 62 in a counterclockwise direction about axis 63. Thereafter, second web 108 proceeds around friction roller 64 which rotates in a clockwise direction about axis 65 and then exits the chill roll assembly 10 in the direction 110. Accordingly, the invention herein allows full use of the assembly regardless of whether the assembly is manipulating a single web or a multitude of webs. Whenever the assembly is operated in asynchronous mode.

Figure 4:
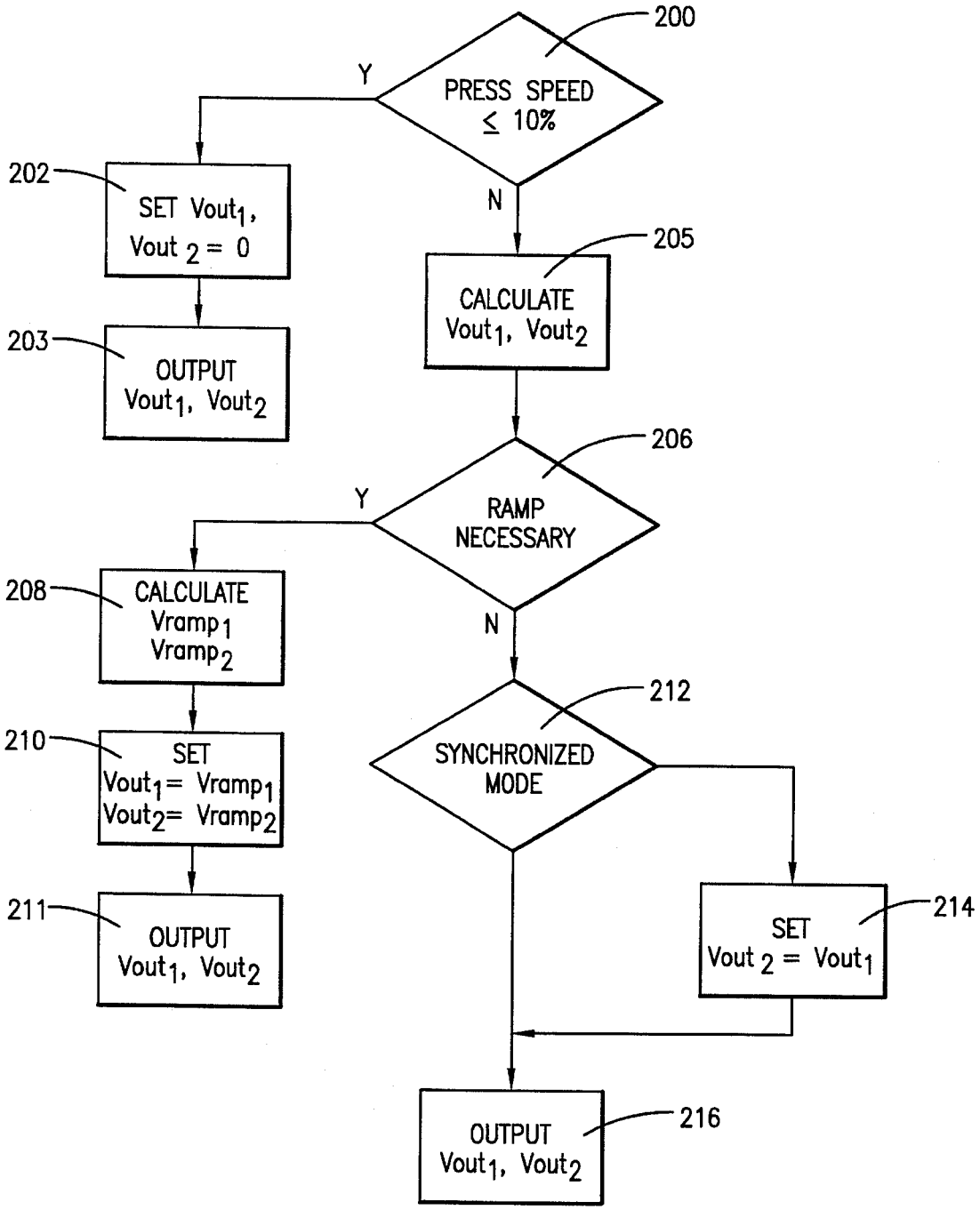
FIG. 4 is a flow diagram illustrating the determination of the appropriate output voltages of a first and a second controller in the chill roll assembly.

Referring now to FIG. 4, the operation of the invention in one embodiment is shown wherein the harmonic drive motors 22 and 34 are not energized with a voltage V-Out$_1$ or V-Out$_2$ over lines 20 or 26, respectively, unless the press speed exceeds 10% of its maximum value. Thus, as is shown in step 200, the calculated voltage potentials V-Out$_1$ and V-Out$_2$ are set equal to 0 if the press speed is less than or equal to 10% of its maximum value. Thereafter, the calculated potentials are actually output as is shown in step 204. However, if the press speed exceeds 10% of its maximum value, then the output voltage levels V-Out$_1$ and V-Out$_2$ are calculated as shown in step 205. In a non-steady state condition, for example, power is about to be or has just been applied, the full voltage potential values, according to the calculated V-Out$_1$ and V-Out$_2$ values, are incrementally reached in a ramp function to avoid damaging the equipment. Thus, if a ramp is necessary, the incremental ramp voltages are determined, as is shown in step 208 and then the calculated voltage potentials V-Out$_1$ and V-Out$_2$ are set to equal those calculated ramp voltages as may be seen in step 210. In one embodiment of the invention herein, the voltage ramp is adapted for increasing the output voltages V-Out$_1$ and V-Out$_2$ from 0 volts to the calculated values based upon controller 12 and 14 inputs over a five second period.

After output voltages for the controllers 12 and 14 are calculated, a selected mode determination in the second controller 14 of FIG. 1 is made as is shown in step 212 to determine whether synchronous or asynchronous operation has been operatively selected by a user. Specifically, if the four chill rolls of FIG. 1 are to be operated in a synchronized manner as is shown in FIG. 2, then V-Out$_2$ is set equal to V-Out$_1$, regardless of its calculated value, due to its input signals reflecting mode tension setting as reflected on line 30 so that the four chill rolls will have rotational speeds that are substantially equal. Conversely, if two webs are being handled by the one chill roll assembly, as is shown in FIG. 3, then the output voltages V-Out$_1$ and V-Out$_2$ will be applied independently of each other and calculated as a function of their respective input values.

As may be shown from FIG. 1, the output voltage V-Out$_1$ from controller 12 is always independent of mode because selected mode is not an input to the first controller 12. However, the output voltage of controller 14, namely V-Out$_2$, is not only a function of the press speed and tension setting, but also of the selected mode. Thus, if the selected mode is asynchronous operation for the simultaneous handling of two webs, then controller 14 merely sets its output voltage V-Out$_2$ according to the tension setting and to the press speed. Finally, as may be seen in FIG. 5, once the output voltages have been calculated according the various modes and press speed as discussed above, the method of controlling the two harmonic drive systems includes the step 204 of actually outputting a voltage V-Out$_1$ on line 20 and V-Out$_2$ on line 26 according to the calculated values as determined previewing.

Note that among other possible embodiments, a coupling means could perform the calculations based upon the various input parameters described herein and then command the two controllers 12 and 14 to produce the appropriate output voltage. Thus, the invention herein would include the apparatus for the coupling means as well as the step of performing the calculations and commanding the controllers 12 and 14 to produce the calculated voltages.

Having described the foregoing invention as set forth above, those of ordinary skill in the art now are in a position to practice such invention and determine easily the components and parameters for use therein, and may make many modifications and changes of the above-described invention without being outside the scope of the claimed invention.

What is claimed is:

1. A chill roll assembly, comprising:

a plurality of sets of chill rolls;

a plurality of means for driving said plurality of chill roll sets, each of said means for driving connected to actuate a corresponding set of chill rolls; and means for controlling said plurality of means for driving said plurality of chill roll sets in a first mode to synchronously actuate said plurality of sets of chill rolls in processing a single web through said plurality of chill rolls sets or in a second mode to asynchronously actuate said plurality of chill roll sets in processing multiple webs, on a one web per set of chill rolls basis, through said plurality of chill roll sets.

2. The chill roll assembly of claim 1 wherein each of said means for driving further comprises a controller.

3. The chill roll assembly of claim 1 wherein each of said means for driving further comprises a motor.

4. The chill roll assembly of claim 1 wherein each of said means for driving further comprises a harmonic drive gear box.

5. The chill roll assembly of claim 1 wherein the means for controlling further comprises means for setting an output voltage of each controller of each of said drive means equal to the output voltage of controller whose output voltage is a calculated value.

6. The chill roll assembly of claim 1 wherein each of said plurality of sets of chill rolls each consist of two chill rolls.

7. A chill roll assembly, comprising:

a first motor;

a second motor;

a first set of chill rolls;

a second set of chill rolls;

a first harmonic drive gearbox for actuating said first set of chill rolls, in response to rotational inputs received from said first motor and a press drive;

a second harmonic drive gearbox for actuating said second set of chill rolls, in response to rotational inputs received from said second motor and said press drive;

a first programmable logic controller connected to said first motor;

a second programmable logic controller connected to said second motor; and means for synchronizing operation of said first and second programmable logic controllers to support a synchronous mode of operation wherein said first and second controllers actuate said first and second motors in a substantially similar manner to operate said first and second sets of chill rolls at a substantially similar speed in processing a single web, and support an asynchronous mode of operation wherein said first and second controllers actuate said first and second motors in a dissimilar manner to operate said first and second sets of chill rolls at a dissimilar speed in independently processing plural webs.

8. The chill roll assembly of claim 7 wherein said means for synchronizing further comprises means for setting an output voltage of said second controller equal to a value of a signal reflecting the output voltage potential of a first controller.

9. The chill roll assembly of claim 7 wherein said means for synchronizing further comprises means for setting an output voltage of said second controller according to a tension setting received by said first controller.

10. The chill roll assembly of claim 7 wherein said means for synchronizing further comprises means for setting an output voltage of said second controller by electrically switching in an output voltage of said first controller so that said first and said second motors are electrically activated by said first controller.

11. The chill roll device having a first harmonic drive system comprising a first programmable logic controller, a first motor, a plurality of chill rolls and a first harmonic drive system for rotationally powering a plurality of chill rolls, the improvement comprising:

adding a second harmonic drive system comprising a second motor, a second harmonic drive system, a second programmable logic controller, and means for synchronizing said first harmonic drive system with said second harmonic drive system to support a synchronous mode of operation for processing a single web and an asynchronous mode of operation for independently processing plural webs wherein said first harmonic drive system activates a first set of said plurality of chill rolls and said second harmonic drive system activates a second set of said chill rolls.

12. The improved chill roll device of claim 11, wherein said means for synchronizing comprises a switch means wherein an electrical potential being output from said first controller is output to said first controller and to said second controller.

13. The improved chill roll device of claim 11, wherein the means for synchronizing comprises an algorithm within said means wherein an output voltage potential of said second controller is set equal to an output voltage potential of said first controller whenever said synchronous mode is selected.

* * * * *